United States Patent [19]

Hokanson

[11] Patent Number: 4,471,836

[45] Date of Patent: Sep. 18, 1984

[54] VENT CONDENSER

[75] Inventor: Allan E. Hokanson, Sycamore Township, Hamilton County, Ohio

[73] Assignee: Arthur C. Knox, Jr., Cincinnati, Ohio

[21] Appl. No.: 339,700

[22] Filed: Jan. 15, 1982

[51] Int. Cl.[3] ..... F28B 9/10

[52] U.S. Cl. ..... 165/111; 55/269; 62/90; 62/509; 165/156; 165/160; 165/163

[58] Field of Search ..... 62/475, 90, 93, 509; 165/111, 113, 160, 114, 184, 110, 163, 156; 55/269, 441; 202/185 E, 185 D

[56] References Cited

U.S. PATENT DOCUMENTS

| | | | |
|---|---|---|---|
| 636,256 | 11/1899 | Gates | 55/269 |
| 949,217 | 2/1910 | Caps | 55/269 |
| 2,285,123 | 6/1942 | Phillips | 62/509 |
| 2,365,791 | 12/1944 | Wineman | 165/163 |
| 2,425,669 | 8/1947 | Brock | 165/160 |
| 2,935,856 | 5/1960 | Gifford | 62/90 |
| 3,100,523 | 8/1963 | Marrujo | 165/160 |
| 3,818,718 | 6/1974 | Freese | 62/90 |
| 4,027,729 | 6/1977 | Bruhl | 165/111 |
| 4,242,110 | 12/1980 | Hynes | 62/90 |

FOREIGN PATENT DOCUMENTS

| | | | |
|---|---|---|---|
| 126399 | 1/1948 | Australia | 55/269 |
| 1111654 | 7/1961 | Fed. Rep. of Germany | 165/156 |
| 634917 | 3/1950 | United Kingdom | 165/111 |
| 1520276 | 8/1978 | United Kingdom | 165/156 |

*Primary Examiner*—Douglas Hart

*Attorney, Agent, or Firm*—James W. Pearce; Roy F. Schaeperklaus

[57] ABSTRACT

A vent condenser that includes an inner tube, an outer shell mounted on and surrounding the inner tube, a middle shell having an annular body and a closed upper end mounted with the body thereof radially spaced between the inner tube and the outer shell, and a helical heat exchange tube mounted in the space between the inner tube and the middle shell in engagement with the body of the middle shell and with the inner tube. A helical channel is formed between the middle shell, the inner tube, and spaced convolutions of the helical tube. Cooling fluid is directed through the helical tube. Discharge from the deaerator vent passes up the inner tube to return along the helical channel to be cooled in indirect heat exchange relation with the cooling fluid in the helical tube to condense water therefrom and to separate the water from noncondensable gases. The noncondensable gases are directed through the space between the middle shell and the outer shell to reheat the noncondensable gases to a sufficient temperature that no substantial plume is formed when the noncondensable gases are discharged through the discharge fitting.

8 Claims, 8 Drawing Figures

FIG. 1
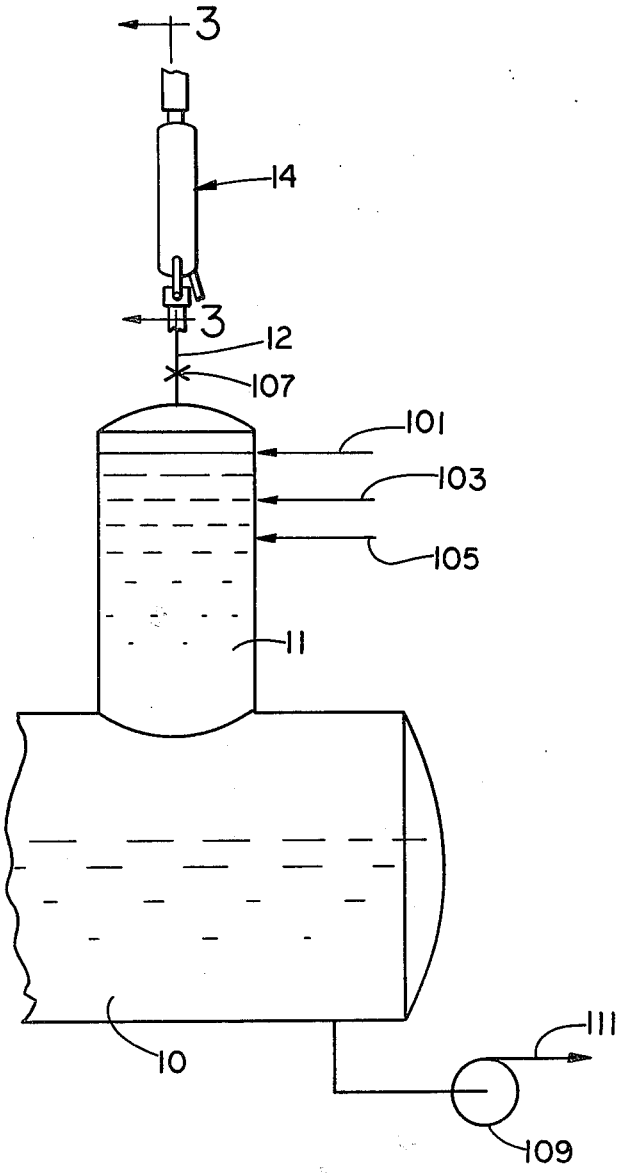
FIG. 7
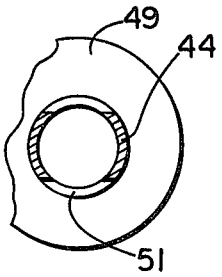
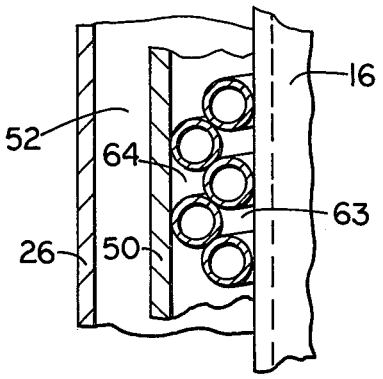
FIG. 8

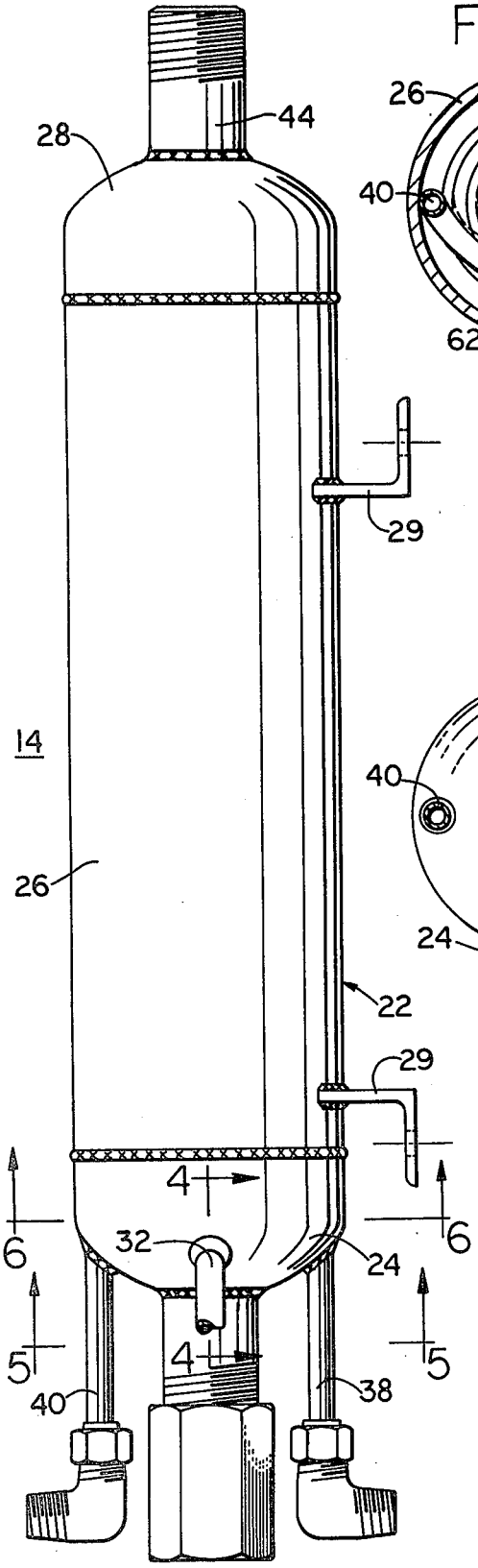
FIG. 2
FIG. 6
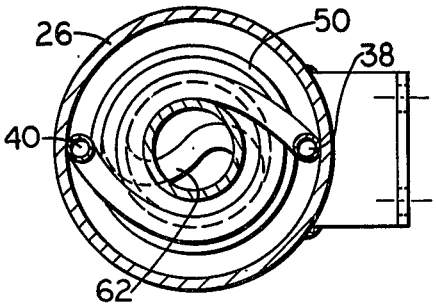
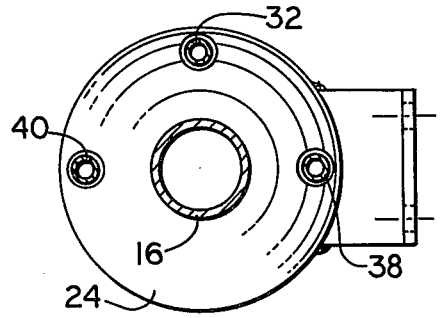
FIG. 5
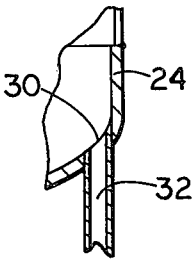
FIG. 4
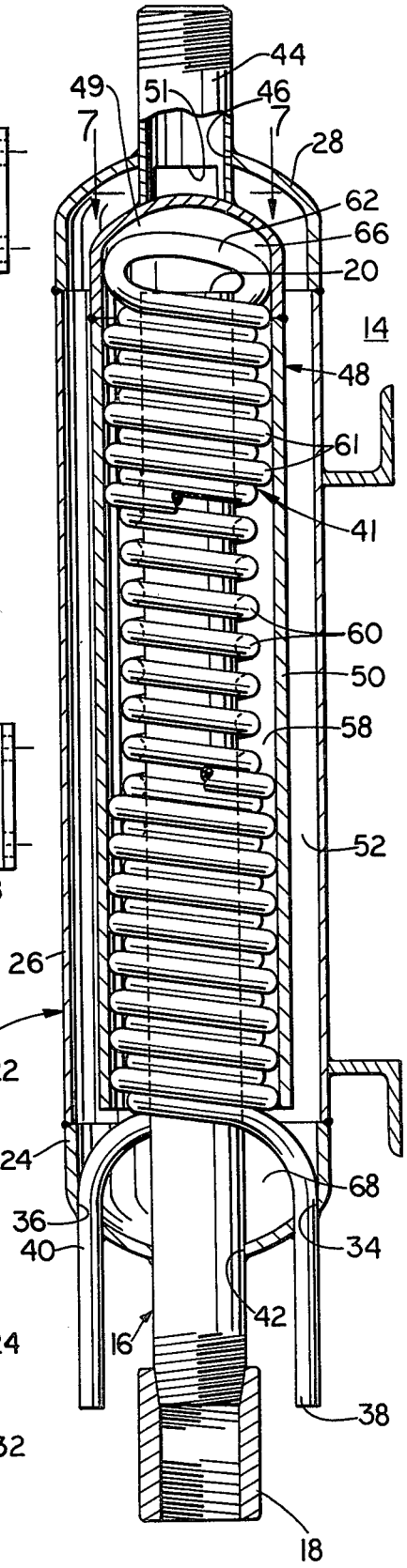
FIG. 3

VENT CONDENSER

BACKGROUND OF THE INVENTION

This invention relates to a condenser for condensing vapor from a mixture of condensable and noncondensable gases.

An object of this invention is to provide a simple condenser and heat exchanger structure that includes a minimum of parts which require fabrication.

A further object of this invention is to provide a vent condenser for a boiler deaerator vent for recovering heat ordinarily lost to the atmosphere by condensing steam present in the mixture of water vapor and noncondensable gases which issue from the boiler deaerator vent.

A further object of this invention is to provide such a device in which both a coolant liquid and the vapor mixture follow elongated paths.

A further object of this invention is to provide a condenser and heat exchanger structure of this type which not only condenses vapor from a deaerator vent stream but also reheats the noncondensable gases passing through a final passage of the exchanger to superheat the gas stream, thus substantially eliminating the formation of a steam plume normally produced by a boiler deaerator vent.

A further object of this invention is to provide a condenser and heat exchanger which de-superheats a vent stream from a deaerator vent, condenses water vapor present in the stream and subcools the condensed liquid, and which condenses other vapors which may be present in the vent stream such as gasoline, alcohols, hydrocarbons and other volatile liquids.

SUMMARY OF THE INVENTION

Briefly, this invention provides a vent condenser that includes a central tube for connecting to a deaerator vent, an outer shell surrounding the inner tube, and a middle shell mounted with a body thereof radially spaced between the inner tube and the outer shell. A helical exchange tube is mounted in the space between the inner tube and the middle shell to form a helical channel between the middle shell, the inner tube, and the helical tube. The tube can include two portions, one portion engaging the inner tube and the other portion engaging the middle shell so that two channel portions are formed. Cooling fluid is directed through the helical tube. Discharge from the deaerator vent is directed up the inner tube to return along the helical channel to be cooled to condense water therefrom and to separate the water from noncondensable gases in the discharge. The noncondensable gases are directed upwardly through the space between the middle shell and the outer shell to reheat the noncondensable gases to a sufficient temperature that no substantial plume is formed when the noncondensable gases are discharged through the discharge fitting.

The above and other objects and features of the invention will be apparent to those skilled in the art to which this invention pertains from the following detailed description and the drawing, in which:

BRIEF DESCRIPTION OF THE DRAWINGS

FIG. 1 is a fragmentary view in side elevation of a feed water storage tank and a deaerator assembly for a steam boiler provided with a vent condenser constructed in accordance with an embodiment of this invention;

FIG. 2 is a view in side elevation of the vent condenser illustrated in FIG. 1 on an enlarged scale;

FIG. 3 is a view in section of the vent condenser taken on an enlarged scale on the line 3—3 in FIG. 1;

FIG. 4 is a fragmentary view in section taken on the line 4—4 in FIG. 2;

FIG. 5 is a view in section taken on the line 5—5 in FIG. 2;

FIG. 6 is a view in section taken on the line 6—6 in FIG. 2;

FIG. 7 is a view in section taken on the line 7—7 in FIG. 3; and

FIG. 8 is a fragmentary view in section taken on an enlarged scale on the same line as FIG. 3.

DESCRIPTION OF THE PRESENTLY PREFERRED EMBODIMENT

In the following detailed description and the drawing, like reference characters indicate like parts.

In FIG. 1 is shown a fragmentary portion of a feed water storage tank 10 for a boiler (not shown in detail) provided with a deaerator heater 11 and deaerator vent 12 through which uncondensable gases that can be present in boiler make-up water and condensate can be bled off. Some steam, which is condensable, accompanies the noncondensable gases. A vent condenser 14 constructed in accordance with an embodiment of this invention is mounted on the deaerator vent 12. Condensate can be introduced into the deaerator vent heater 11 through a line 101. Boiler make-up water can be introduced into the deaerator heater 11 through a line 103. Steam can be introduced into the deaerator heater 11 through a line 105. A valve 107 controls flow of steam and noncondensable gases through the deaerator vent 12. Water from the feed water storage tank 10 can be pumped by a pump 109 through a line 111 to the boiler.

The vent condenser 14 includes an upright inner tube 16, which is connected to the deaerator vent 12 by an internally threaded sleeve 18. At the upper end of the inner tube 16 is a discharge opening 20. An outer shell 22 is mounted on the inner tube 16. The outer shell 22 includes a lower cap 24, a tubular body 26, and an upper cap 28. Brackets 29 on the body 26 can be attached to appropriate supports (not shown).

The lower cap 24 is provided with a discharge opening 30 in which a liquid discharge pipe 32 (FIG. 4) is mounted. An appropriate valve (not shown) can be mounted on the discharge pipe 32. The lower cap 24 is also provided with openings 34 and 36 in which a tube inlet 38 and a tube outlet 40 of an elongated helical heat exchange coil 41 are mounted, respectively. The inner tube 16 enters the outer shell 22 through a central opening 42 in the lower cap 24. The upper cap 28 supports a noncondensable gas discharge fitting 44 which extends through a central opening 46 in the upper cap 28. A middle shell 48 is mounted on a lower end of the fitting 44. The middle shell 48 includes an inverted cupshaped upper cap portion 49 and a tubular body 50. Openings 51 in the fitting 44 permit communication from an annular space 52 between the middle shell 48 and the outer shell 22 to the interior of the fitting 44.

The upper cap portion 49 of the middle shell closes the lower end of the fitting 44. The tubular body 50 is coaxial with the central tube 16 and radially spaced from the central tube 16 to form an annular space 58 therebetween.

The elongated helical heat exchange coil 41 is mounted in the space 58. The coil 41 includes an inner helical section 60, a central tube section 62 and an outer helical section 61. The inner helical section 60 includes spaced convolutions wrapped tightly on the inner tube 16 and extends from the tube inlet 38 to the central tube section 62. The outer helical section also consists of spaced convolutions and extends from the central tube section 62 to the tube outlet 40. Convolutions of the inner helical section are spaced sufficiently to form an inner helical channel 63 therebetween which is narrower than the width of the coil 41. Convolutions of the outer helical section bridge convolutions of the inner section and also extend to the tubular body 50 of the middle shell 48 to form a second helical channel 64 therebetween, which is also narrower than the width of the coil 41. The central tube section 62 overlies the discharge opening 20 in the inner tube 16 and is spaced therefrom and from the upper cap portion 49 of the middle shell so that the coil 41 can expand and contract without binding.

The discharge from the deaerator vent 12, which can be at a superheated temperature such as 226° F., contains condensable water vapor and gases which are noncondensable at ambient pressure and temperature such as nitrogen, oxygen and other constituents of air. The discharge from the deaerator vent is directed upwardly through the inner tube 16 into an upper chamber 66 above the discharge opening 20 and from the upper chamber 66 passes downwardly through the helical channels 63 and 64 inside the middle shell 48 to discharge from the middle shell into a lower chamber 68 inside the lower cap 24 as condensable water is condensed therefrom. From the lower chamber 68, the noncondensable gases flow upwardly through the space between the middle shell 48 and the outer shell 22 and through the openings 51 to be discharged through the fitting 44 to the atmosphere. Cooling water enters the coil 41 through the tube inlet 38 at storage temperature, which can be in the neighborhood of 60° F. and can be heated as it passes through the coil 41 to a temperature such as 100° F. at which the cooling water is discharged through the tube outlet 40. As the mixture of condensable and noncondensable gases passes downwardly from the upper chamber 66 through the helical channels 63 and 64, the mixture is cooled and water condenses and is subcooled to fall to the lower chamber 68 to be discharged therefrom through the liquid discharge pipe 32. The noncondensable gases in the lower chamber 68 may be at a reduced temperature such as 120° F. The noncondensable gases are heated as they rise through the space 52 between the middle shell 48 and the outer shell 22 and can be at an elevated temperature such as 200° F. as they pass through the opening 51 so that, when the noncondensable gases are discharged into the atmosphere, any remaining water vapor does not condense as a plume but is dissipated as vapor.

The vent condenser illustrated in the drawings and described above is subject to structural modification without departing from the spirit and scope of the appended claims.

Having described my invention, what I claim as new and desire to secure by letters patent is:

1. A vent condenser which comprises an inner tube for connecting to a deaerator vent, an outer shell mounted on and surrounding the inner tube, a middle shell having an annular body and a closed upper end mounted with the body thereof radially spaced between the inner tube and the outer shell, a discharge fitting for noncondensable gases mounted on the outer shell and connected to the space between the middle shell and the outer shell, a helical heat exchange tube mounted in the space between the inner tube and the middle shell in engagement with the body of the middle shell and with the inner tube, the helical tube having spaced convolutions to form a helical channel between the middle shell, the inner tube, and the helical tube, means for directing cooling fluid through the helical tube, and means for directing discharge from the deaerator vent up the inner tube to return through the helical channel to be cooled in indirect heat exchange relation with the cooling fluid in the helical tube to condense water from the discharge and to separate the water from noncondensable gases in the discharge and for directing the noncondensable gases upwardly through the space between the middle shell and the outer shell to reheat the noncondensable gases to a sufficient temperature that no substantial plume is formed when the non-condensable gases are discharged through the discharge fitting.

2. A vent condenser as in claim 1 in which the helical tube includes two sections which are connected to each other, convolutions of one of the sections being in engagement with the inner tube, convolutions of the other section being in engagement with the body of the middle shell, the convolutions of the first section being in engagement with the convolutions of the other section, whereby the helical channel includes two portions, one of the portions being along the inner tube, the other of the portions being along the body of the middle shell.

3. A vent condenser as in claim 2 in which an inlet for the helical tube is connected to the section in engagement with the inner tube and an outlet for the helical tube is connected to the section in engagement with the body of the middle shell.

4. A vent condenser as in claim 3 in which there is a bottom chamber in the outer shell below a lower end of the middle shell and the inlet and the outlet extend through the bottom chamber, the sections of the helical tube extending upwardly from the inlet and outlet.

5. A vent condenser as in claim 4 in which there is a water drain communicating with the bottom chamber for removing water therefrom.

6. A vent condenser which comprises an inner tube for connecting to a deaerator vent, an outer shell mounted on and surrounding the inner tube, a middle shell having an annular body and a closed upper end mounted with the body thereof radially spaced between the inner tube and the outer shell, a discharge fitting for noncondensable gases mounted on the outer shell and connected to the space between the middle shell and the outer shell, a helical heat exchange tube mounted in the space between the inner tube and the middle shell in engagement with the body of the middle shell and with the inner tube, the helical tube including two sections which are connected to each other, convolutions of one of the sections being in engagement with the inner tube, convolutions of the other section being in engagement with the body of the middle shell, the convolutions of the first section being in engagement with the convolutions of the other section, whereby the helical channel includes two portions, one of the portions being along the inner tube, the other of the portions being along the body of the middle shell, an inlet for the helical tube being connected to the section in engagement with the inner tube and an outlet for the helical tube being connected to the section in engagement with the body of the middle shell, the helical tube having spaced convolutions to form a helical channel between the middle shell, the inner tube, and the helical tube, means for directing cooling fluid through the helical tube, there being a bottom chamber in the outer shell below a lower end of the middle shell, the inlet and the outlet extending through the bottom chamber, the sections of the helical tube extending upwardly from the inlet and the outlet, the sections of the helical tube being connected by a central tube section which overlies and is spaced above an upper end of the inner tube, and means for directing discharge from the deaerator vent up the inner tube to return through the helical channel to be cooled in indirect heat exchange relation with the cooling fluid in the helical tube to condense water from the discharge and to separate the water from noncondensable gases in the discharge and for directing the noncondensable gases upwardly through the space between the middle shell and the outer shell to reheat the noncondensable gases to a sufficient temperature that no substantial plume is formed when the noncondensable gases are discharged through the discharge fitting.

7. A vent condenser as in claim 6 in which there is a water drain communicating with the bottom chamber for removing water therefrom.

8. A vent condenser which comprises an inner tube, an outer shell mounted on and surrounding the inner tube, a middle shell having an annular body and a closed upper end mounted with the body thereof radially spaced between the inner tube and the outer shell, a discharge fitting for noncondensable gases mounted on the outer shell and connected to the space between the middle shell and the outer shell, a helical heat exchange tube mounted in the space between the inner tube and the middle shell in engagement with the body of the middle shell and with the inner tube, the helical tube having spaced convolutions to form a helical channel between the middle shell, the inner tube, and the helical tube, means for directing cooling fluid through the helical tube, and means for directing discharge from a vent up the inner tube to return along the helical channel to be cooled in indirect heat exchange relation with the cooling fluid in the helical tube to condense vapor from the discharge and to separate condensate from noncondensable gases in the discharge.

* * * * *